US008813955B2

(12) United States Patent
Böttger et al.

(10) Patent No.: US 8,813,955 B2
(45) Date of Patent: Aug. 26, 2014

(54) CONTAINER FOR MEDICAL PRODUCTS AND METHOD FOR PRODUCTION OF SAID CONTAINER

(75) Inventors: Frank Böttger, Ravensburg (DE); Benjamin Böbst, Mittelbiberach (DE); Patricia Koch, Ulm (DE)

(73) Assignee: Arzneimittel GmbH Apotheker Vetter & Co. Ravensburg, Ravensburg (DE)

( * ) Notice: Subject to any disclaimer, the term of this patent is extended or adjusted under 35 U.S.C. 154(b) by 96 days.

(21) Appl. No.: 12/999,241

(22) PCT Filed: Jun. 18, 2009

(86) PCT No.: PCT/EP2009/004385

§ 371 (c)(1),
(2), (4) Date: Dec. 15, 2010

(87) PCT Pub. No.: WO2009/153039

PCT Pub. Date: Dec. 23, 2009

(65) Prior Publication Data

US 2011/0089065 A1 Apr. 21, 2011

(30) Foreign Application Priority Data

Jun. 19, 2008 (DE) ..... 10 2008 030 273

(51) Int. Cl.

| | |
|---|---|
| ***B65D 25/08*** | (2006.01) |
| ***F26B 5/06*** | (2006.01) |
| ***A61J 1/00*** | (2006.01) |

(52) U.S. Cl.
CPC ..... *A61J 1/00* (2013.01); *F26B 5/06* (2013.01)
USPC ..... 206/219; 53/428; 206/364; 604/89; 604/92

(58) Field of Classification Search
USPC ..... 206/219, 221, 229, 364, 365, 438; 604/89, 92, 414; 53/428, 431, 440
See application file for complete search history.

(56) References Cited

U.S. PATENT DOCUMENTS 3,240,328 A * 3/1966 Matteuzzi ..... 206/219
3,269,905 A * 8/1966 Alder et al. ..... 206/459.5

(Continued)

FOREIGN PATENT DOCUMENTS

CA 2118034 10/1993
CA 2397829 2/2003

(Continued)

OTHER PUBLICATIONS

International Search Report, ISA/EP, Rijswijk, NL, mailed Sep. 23, 2009.
International Preliminary Examination Report, issued Jun. 1, 2010.
First Office Action regarding Japan Application No. 2011-513948 mailed Feb. 26, 2013. Translation provided by Suzuye & Suzuye.

*Primary Examiner* — Luan K Bui
(74) *Attorney, Agent, or Firm* — Harness, Dickey & Pierce, P.L.C.

(57) ABSTRACT

A container for medical products has at least one chamber. At least two lyophilized active substances and/or auxiliary substances are jointly present in the at least one chamber.

16 Claims, 2 Drawing Sheets

(56) References Cited

U.S. PATENT DOCUMENTS

| | | | | | |
|---|---|---|---|---|---|
| 3,337,041 | A | * | 8/1967 | Damaskus | 206/364 |
| 3,724,820 | A | * | 4/1973 | Bonjour et al. | 366/273 |
| 4,254,768 | A | * | 3/1981 | Ty | 604/89 |
| 4,722,733 | A | * | 2/1988 | Howson | 604/89 |
| 5,067,051 | A | * | 11/1991 | Ladyjensky | 206/219 |
| 5,488,544 | A | * | 1/1996 | Ladyjensky | 206/219 |
| 5,549,561 | A | | 8/1996 | Hjertman | |
| 5,552,968 | A | * | 9/1996 | Ladyjensky | 206/219 |
| 6,889,826 | B2 | * | 5/2005 | Harada et al. | 206/219 |

FOREIGN PATENT DOCUMENTS

| | | |
|---|---|---|
| DE | 69322631 | 10/1993 |
| DE | 10140704 | 3/2003 |
| GB | 798147 | 7/1958 |
| WO | 2007076023 A2 | 7/2007 |

* cited by examiner

CONTAINER FOR MEDICAL PRODUCTS AND METHOD FOR PRODUCTION OF SAID CONTAINER

CROSS-REFERENCE TO RELATED APPLICATIONS

This application is a 371 U.S. National Stage of International Application No. PCT/EP2009/004385, filed Jun. 18, 2009. This application claims priority to German Patent Application No. 10 2008 030 273.2, filed Jun. 19, 2008. The disclosures of the above applications are entirely incorporated by reference herein.

FIELD

The invention relates to a container for medical products.

BACKGROUND

Such containers are well known. They typically have a chamber in which an active substance and/or auxiliary substance is present. Said active substance and/or auxiliary substance can be present as solid phase—for example lyophilized—or also in the form of a solution. If a plurality of active substances and/or active substances is to be administered together to a patient it is advantageous to mix them only shortly before administering. In this manner it is often possible to achieve a longer shelf life of the substances, in particular if the substances are able to react with each other.

In the known containers, different chambers are provided for this purpose, wherein in each of the chambers which are separated from each other, one active and/or auxiliary substance is present separately. Known are, for example, so-called dual-chamber systems which have two chambers which are separated from each other. Here, means are provided which allow to connect the two chambers to each other shortly before administering the medicament so that a mixing of the components, which are previously separated, can be carried out. In a second step, a dose of the mixed medicament is administered to the patient.

The disadvantage of the known systems is that in case of complex compositions of a medicament, a separate chamber has to be provided for each active substance and/or auxiliary substance. This means that either a plurality of individual containers with different active substances and/or auxiliary substances must be available or that a very complex container must be provided which has a plurality of interconnectable chambers.

SUMMARY

It is therefore the object of the invention to provide a container which does not have the mentioned disadvantages.

This object is solved by a container having at least one chamber and characterized in that at least two lyophilized active substances and/or auxiliary substances are present jointly in the at least one chamber. Due to the fact that the active substances and/or auxiliary substances are present in lyophilized form, the molecular components are immobilized and, accordingly, are inert. This means that the active substances and/or auxiliary substances react slowly with each other even if the lyophilized substances are present in an intimately mixed state. Even in such an unfavorable storage form—namely the intimate admixture—the substances thus can be stored significantly longer than would be the case if they would be jointly present in solution.

Particularly preferred is a container for which is provided that at least two active substances and/or auxiliary substances are present arranged in layers. In this case, the individual components touch each other only at the surfaces with which they abut against each other. In this respect, a reaction is possible only to a very limited extent. Thus, the shelf life is significantly improved again compared to an intimate admixture.

Also preferred is a container in which the at least two active substances and/or auxiliary substances are present separated from each other by at least one lyophilized neutral substance. It is addressed here that a lyophilized neutral substance spatially separates the individual active substances and/or auxiliary substances from each other. The active components, thus the active substances and/or auxiliary substances do not touch each other but come into contact only with the neutral substance. The neutral substance is selected here such that the neutral substance reacts very slowly with the active components and preferably not at all. In this manner, the shelf life can be significantly improved again.

Particularly preferred in this connection is a container which is characterized in that the at least two active substances and/or auxiliary substances are present arranged in layers and are separated from each other by at least one layer of a lyophilized neutral substance. In this case, thus, a defined layering exists, wherein between each two layers of active components, at least one layer of a lyophilized neutral substance is arranged so that the active components do not touch each other. In this manner, a very long shelf life of the active components is ensured.

Principally, the container can be any container for medical products. However, it is preferred that the container is a syringe, a carpule, a dual- or multi-chamber system, a vial, an infusion bag or an infusion bottle. If the container involves a single-chamber system, a solvent has to be introduced into the container prior to administering in order to dissolve the active components. Then, for example, the solution can be drawn into a syringe and can be administered to the patient. Of course, it is also possible that the patient drinks the solution prepared in this manner or uses it externally, for example, by applying it onto the skin. In contrast, in multi-chamber systems, the solvent is usually already present in a separate chamber. In this case it is only necessary to bring the chamber in fluid communication to the active components so that the solvent can dissolve the active components. After this, the solution can be administered to the patient.

Further configurations of the container arise from the subclaims.

It is a further object of the invention to provide a method for producing such a container.

To solve this object, a method is proposed by means of which a container according to the invention can be produced.

Provided is a container for medical products which has at least one chamber. The solution of a first active substance and/or auxiliary substance is filled into the chamber and quick-frozen. After this, a further solution of an active substance and/or auxiliary substance is filled into the at least one chamber, whereupon also said further solution is quick-frozen. The last two steps—thus filling in a further solution and quick-freezing the further solution—can be repeated as often as desired until a desired number of active substances and/or auxiliary substances is present in the at least one chamber of the container. In this manner, layers of quick-frozen substances are created which are typically arranged one above the other. After the filling process is completed, the frozen solutions are jointly lyophilized in the container. Here, the solvent vapor sublimates from the lower layers through the layers arranged further up.

Particularly preferred is a method which is characterized in that after quick-freezing a solution of an active substance and/or auxiliary substance, first a neutral substance, preferably a solution of a neutral substance, is filled into the at least one chamber. This neutral substance or its solution is then quick-frozen before the next solution of an active substance and/or auxiliary substance is filled into the at least one chamber. In this manner, layers of neutral substances are created which are able to separate individual layers of the active components from each other.

DRAWINGS

The invention is illustrated in more detail hereinafter by means of the drawing. In the figures.

DETAILED DESCRIPTION

Figure 1:
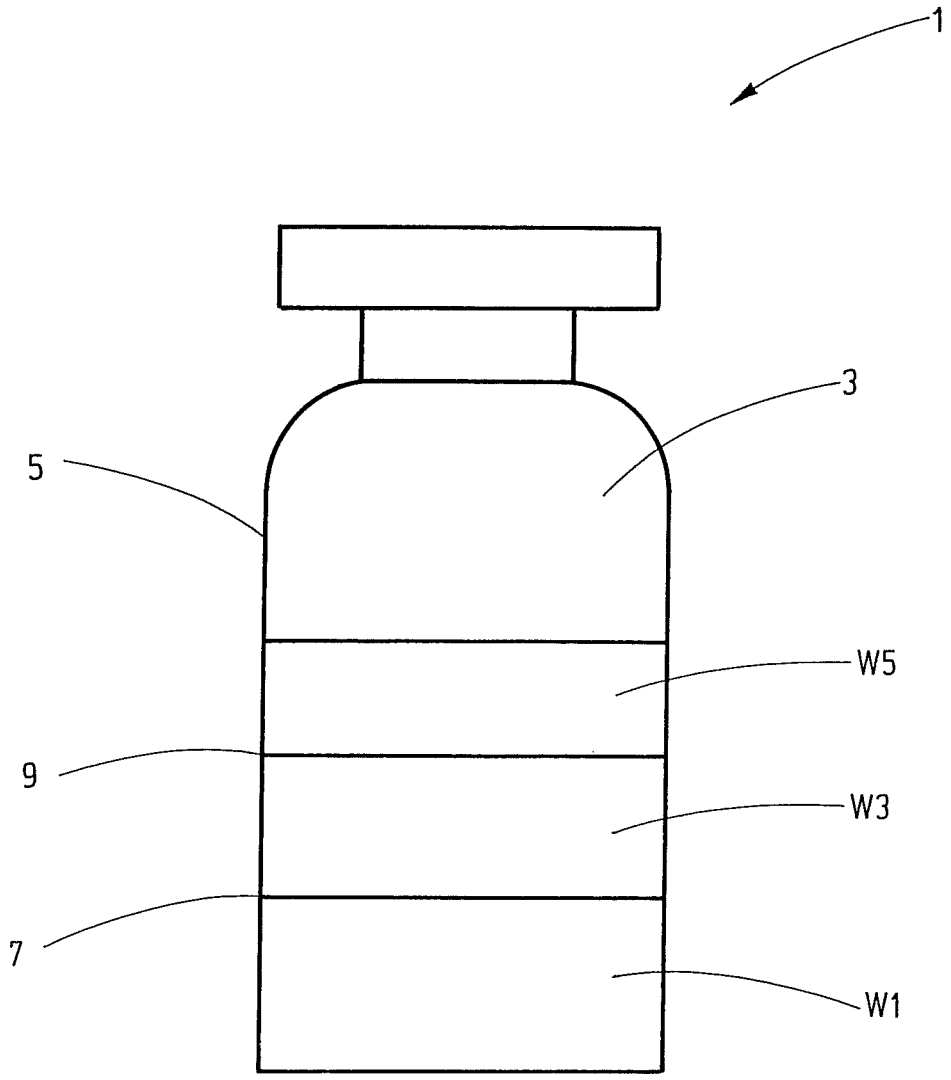
FIG. 1 shows a schematic view of a container configured as vial.

FIG. 1 shows a container 1 for medical products. The container 1 has a chamber 3 which is suitable for accommodating medical products. The chamber 3 is enclosed by the outer wall 5 of the container so that the illustrated container 1 has only one single chamber 3. It is also possible to separate a plurality of chambers 3 within the container from each other, for example, by introducing intermediate floors into the chamber 3.

In the chamber 3, three different active substances and/or auxiliary substances W1, W3 and W5 are present which are lyophilized and arranged in layers one above the other. It is also possible to arrange the active substances and/or auxiliary substances—hereinafter also called active components—W1, W3 and W5 in a different geometrical arrangement. In particular, the individual quick-frozen active components can also be ground or crushed and mixed together. However, in doing so, the surface at which the active components W1, W3 and W5 touch each other is increased so that potentially occurring reactions are accelerated. In the context of the shelf life of the active components W1, W2 and W5 it is thus advantageous to arrange the same in layers or side by side. In this case, the active components W1, W3 and W5 touch each other only at the contact surfaces 7 and 9, whereby reactions between the components W1 and W3, on the one hand, and the components W3 and W5, on the other, can take place only with a significantly reduced reaction rate. A reaction of the component W1 with the component W5 is excluded because the same are spatially separated from each other by the component W3.

The container 1 is illustrated here as vial; however, the container can also be a syringe, carpule, a dual- or multi-chamber system, an infusion bag or an infusion bottle. It is essential, however, that at least two quick-frozen active substances and/or auxiliary substances W1, W3, W5 are jointly present in at least one chamber 3.

Figure 2:
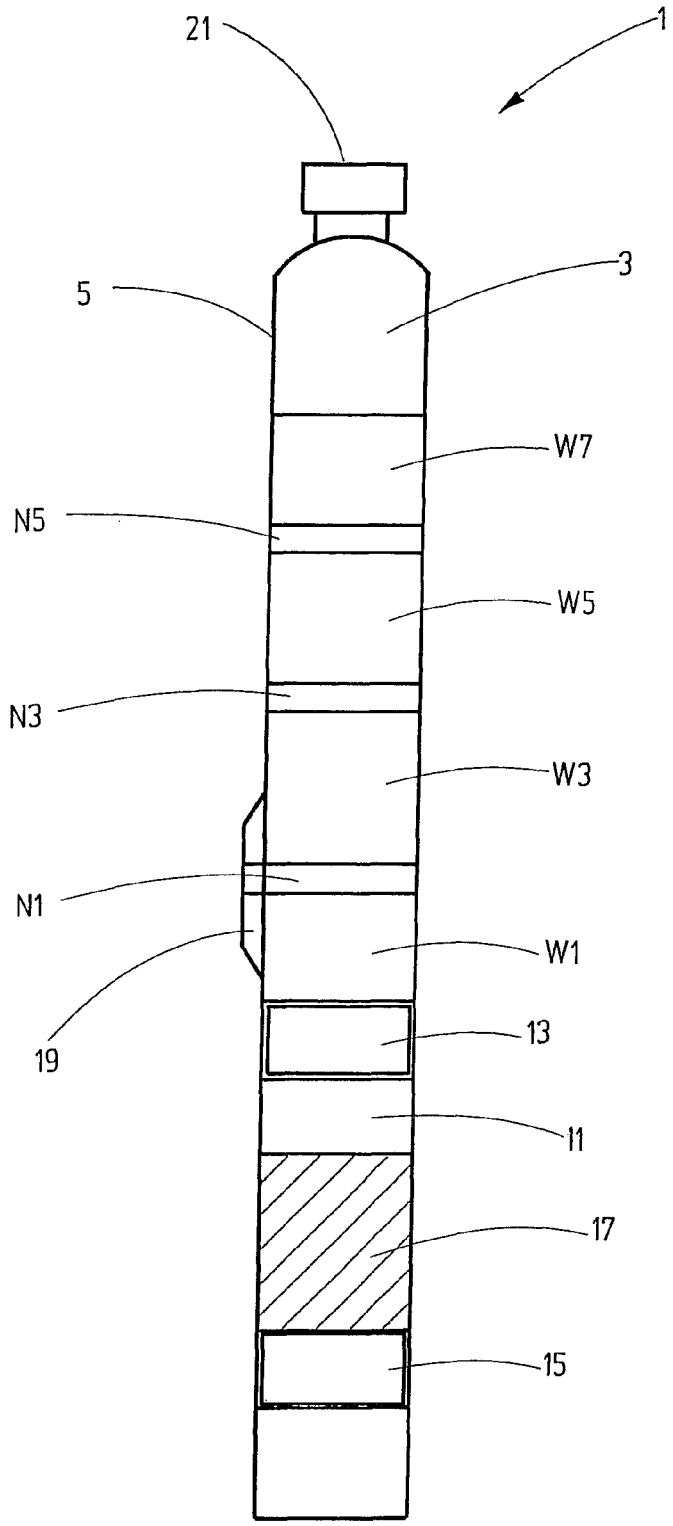
FIG. 2 shows a container configured as dual-chamber system.

FIG. 2 shows a further exemplary embodiment of a container 1 for medical products which is configured as dual-chamber system. Identical and functionally identical elements are indicated by identical reference numbers so that in this respect, reference is made to the previous description.

Here, the container 1 has a second chamber 11 next to the first chamber 3. Both chambers are bordered by the outer wall 5 of the container 1. The first chamber 3 is separated with respect to the second chamber 11 by a center plug 13 which is arranged displaceable in the container 1. The second chamber 11—as viewed by the viewer of FIG. 2—is closed towards the bottom end of the container 1 by an end plug 15 which is also arranged displaceable in the container 1. The plugs 13 and 15 are tightly abutting against the outer wall 5 of the container 1 but can slide on the same so that the plugs are displaceable.

In the present exemplary embodiment, four different active substances and/or auxiliary substances W1, W3, W5 and W7 are layered in lyophilized form on top of each other in the first chamber 3. In contrast to the exemplary embodiment shown in FIG. 1, here, the active components W1, W3, W5 and W7 do not touch each other directly, but there are layers of lyophilized neutral substances or lyophilized solutions of neutral substances N1, N3 and N5 arranged between the active components W1, W3, W5 and W7. Therefore, there are no surfaces at which in each case two active components W1, W3, W5 or W7 touch each other, but each surface of an active component W1, W3, W5 or W7 touches either a wall of the chamber 3 or an outer surface of a lyophilized neutral component N1, N3 or N5. In this manner, a contact between the active components W1, W3, W5 and W7 is completely avoided so that chemical or biochemical reactions between the active components W1, W3, W5 or W7 are excluded. This results in a very long shelf life of the active components W1, W3, W5 and W7. In principal, the active components W1, W3, W5 and W7 and the neutral components N1, N3 and N5 can also be present in a geometrical arrangement other than the illustrated one. It is important, however, that a direct contact between the surfaces of the active components W1, W3, W5 and W7 is prevented in that in each case one neutral component N1, N3 and N5 is arranged between such surfaces of the active components W1, W3, W5 and W7 which otherwise would touch each other.

The second chamber 11 comprises a solvent 17 which is capable to dissolve at least the active components W1, W3, W5 and W7. Preferably, the neutral components N1, N3 and N5 can also be dissolved by the solvent 17. In the illustrated storage state of the container 1, the first chamber 3 and the second chamber 11 are separated from each other by a center plug 13 so that the solvent 17 can not come into contact with the components W1, W3, W5, W7, N1, N3 and N5. Shortly before administering the medicament to a patient, however, the solvent 17 can be conveyed from the chamber 11 into the chamber 3 to dissolve the components W1, W3, W5, W7, N1, N3 and N5 contained therein.

For this, a region with a larger diameter at the outer wall of the container 1 is provided, which region has an extension along the longitudinal axis of the container 1 which is greater than the extension of the center plug 13 along the same axis. Hereby, the region with the larger diameter can act as bypass 19. Here, the region with the larger diameter covers only a small angular range in the circumferential direction of the container 1 so that the center plug 13 is securely guided also in the region of the bypass 19 by the outer wall 5 of the container 1.

If the medicament needs to be administered to a patient, the procedure is as follows: First, the end plug 15—as viewed by the viewer of FIG. 2—is displaced towards the upper end of the container 1 so that via the pressure forces transmitted in this manner into the second chamber 11, also the center plug 13 is displaced in the same direction. Here, the center plug 13 is displaced until it arrives in a center region of the bypass 19 so that the first chamber 3 is connected to the second chamber 11 via the bypass 19. If now the end plug 15 is further displaced in the same direction, the solvent 17 flows around the center plug 13 and thus gets into the first chamber 3. There, the solvent 17 dissolves at least the active components W1, W3, W5 and W7 and preferably also the neutral components N1, N3 and N5. When further displacing the end plug 15 towards the center plug 13, there is now a position in which both plugs 13, 15 touch each other. If now the end plug 15 is further displaced—as viewed by the viewer—in the upper region of the container 1, the end plug carries the center plug 13 along so that the latter is also displaced in the same direction. Hereby, the solution present in the first chamber 3 is pushed in the direction towards the top end 21 of the container 1. There, an opening can be provided through which the solution can be extracted. For example, the top end 21 of the container 1 can be equipped with a cannula through which the solution is injected into a patient. However, it is also conceivable that the patient takes the solution from the first chamber 3 and drinks it or uses it externally or that the solution is administered to the patient as enema. Other ways which are common in medicine for administering a medicament are also possible. It is essential, however, that initially a plurality of active substances and/or auxiliary substances are jointly present in a chamber so that, on the one hand, complicated multi-chamber systems with separate chambers for each components are avoided and, on the other, the active components can not enter into a chemical or biochemical reaction with each other. Only shortly before administering the medicament to a patient, the active components are to be dissolved in a solvent and thus to be brought into an administrable state.

In the following, the method for producing a container according to the invention is explained in more detail. First, a container 1 is provided which has at least one chamber 3. Then, a solution of a first active substance and/or auxiliary substance W1 is filled into a chamber 3. Then, the solution is quick-frozen. This can be carried out, for example, in a deep-freeze line, in a bath with liquid nitrogen or in similar devices. It is essential, however, that that the first solution is frozen. During the following process it must be avoided that the frozen solution defrosts again. Therefore, the container 1 has to be maintained during the entire following process at a temperature which is lower than the melting point of the first solution.

After freezing the first solution, a second solution of an active substance and/or auxiliary substance W3 is introduced into the chamber 3. Said solution is quick-frozen as fast as possible so that at the interface between the first and the second solution no significant melting process can take place. Also the second frozen solution is not allowed to defrost during the further process so that the container 1 has to be maintained at a temperature which is lower than the melting point of the second solution. Generally, the container 1 is preferably maintained during the entire process at a temperature which is lower than the lowest melting point of the frozen solutions which are to be introduced into the chamber 3 of the container 1.

In the exemplary embodiment according to FIG. 1, a third solution of an active substance and/or auxiliary substance W5 is applied on top of the frozen second solution, which third solution is quick-frozen as well. Thus, three quick-frozen solutions arranged on top of each other are present. It is possible, of course, to arrange only two solutions on top of each other. However, it is also possible to arrange more than three quick-frozen solutions on top of each other. How many quick-frozen solutions are arranged on top of each other in the chamber 3 of the container 1 is exclusively determined by the desired effect in the patient, on the one hand, and the chemical or, respectively, biochemical compatibility between the active substances and/or the auxiliary substances. Thus, for example, it is also possible to provide and quick-freeze, in the same solution, a plurality of active substances and/or auxiliary substances W1, W3, W5 which do not react with each other, while further reactive active substances and/or auxiliary substances W1, W3, W5 are arranged in separate quick-frozen solutions. It is essential that a separation of active substances and/or auxiliary substances W1, W3, W5 takes place which, when in contact with each other, would react chemically or biochemically.

Once all desired solutions are quick-frozen and present in the container 1, the same is introduced into a lyophilization device and the frozen solutions contained in the chamber 3 are lyophilized in the container 1. Here, the solvent vapor of the lower components—as viewed by the viewer of FIG. 1—has to sublimate through the upper components—as viewed by the viewer of FIG. 1.

Upon completion of the lyophilization process, the lyophilized active components W1, W3, W5 are present in the chamber 3 of the container 1 and are separated from each other and layered on top of each other. If, as illustrated in FIG. 1, the container 1 is a vial, a solvent 17 can be added from outside, for example, by means of a syringe. After dissolving the active components W1, W3, W5 the solution can be extracted from the vial, for example, by means of a syringe and can be administered to a patient. In this case too, of course, the solution can be administered to the patient in other ways common in medicine.

To be able to check the shelf life and freshness of the active components W, W3, W5, components can be integrated in the individual lyophilized layers, which layers, when dissolved and mixed by a solvent 17 react with each other thereby generating a chemiluminescence or bioluminescence phenomenon. In this case, the user can observe a luminescence phenomenon if the active components W1, W3 and W5 did not have the possibility to react with each other during storage. If, in contrast, a reaction took place, the preferably faster reacting reactive luminous components have already reacted with each other so that in the case of a usage, a luminescence phenomenon can not be observed anymore.

In particular if the active components W1, W3, W5 are very active substances and/or auxiliary substances which, in particular during reactions with each other have a very high reaction rate, it is necessary to arrange layers of neutral components N1, N3, N5 between the active components W1, W3, W5, W7 as it is illustrated in FIG. 2. This can be carried out in that after quick-freezing of a solution of an active substance and/or auxiliary substance W1, W3, W5, W7, first a neutral substance N1, N3, N5 or a solution of the neutral substance is filled into the first chamber 3 of the container 1. Thereafter, the neutral substance N1, N3, N5 or the solution of the neutral substance is quick-frozen and only then, the next active component W1, W3, W5, W7 is filled in. It is obvious that not necessarily all active components W1, W3, W5, W7 have to be separated from each other by layers of neutral components N1, N3, N5. In general it is sufficient to separate only those active components which react with each other with a reaction rate that is significant on the time scale of the storage of the container 1. Thus, it is possible, for example, to separate the components W1 and W3 by a neutral component N1 from each other, whereas, for example, the components W3 and W5 can be arranged directly on top of each other if they do not have a significant reaction rate with each other. In this respect, any variations with respect to the sequence of active components W1, W3, W5, W7 and neutral components N1, N3, N5 are conceivable. If quick-frozen neutral components are arranged between active components it is provided also in this case that finally after the chamber 3 of the container 1 is completely filled, all components are jointly lyophilized.

The individual steps of the illustrated method can also be carried out in a sequence other than the one described here; the only important thing is that the product resulting from the method is a container in which at least two lyophilized active substances and/or auxiliary substances W1, W3, W5, W7 are jointly present in at least one chamber 3.

Overall, it is apparent that the present invention provides a method and a device which allows to jointly arrange different, potentially reactive active substances and/or auxiliary substances W1, W3, W5, W7 in one single chamber 3 without the substances reacting with each other. In this manner, complex systems in which for each active component an individual chamber is provided can be avoided. Alternatively, it is not necessary to provide a plurality of individual vials with the individual components, which makes the mixing process prior to administering prone to error and complicated. At the same time, a very good shelf life of the active components is achieved. The concept is extremely simple and can be implemented in any commercially available lyophilization line.

The invention claimed is:

1. A container for medical products comprising:

at least one chamber; and at least two layers of lyophilized active substances and/or auxiliary substances jointly present in the at least one chamber, luminous components integrated in the at least two layers, and separated from each other by at least one lyophilized neutral substance, wherein one of the at least one lyophilized neutral substance separates two of the at least two layers of lyophilized active substances and/or auxiliary substances such that the at least two layers of lyophilized active substances and/or auxiliary substances do not touch one another and there is no chemical or biochemical reaction between the at least two layers, wherein when the active substances and/or auxiliary substances are dissolved and mixed by a solvent, the luminous components react with each other to generate a chemiluminescence or bioluminescence phenomenon, which indicates that the active substances and/or auxiliary substances have not reacted with each other prior to being dissolved and mixed by the solvent, wherein the luminous components react with each other at a faster rate than the rate at which the active substances and/or auxiliary substances react with each other.

2. The container according to claim 1, wherein the at least one lyophilized neutral substance comprises at least one layer of the at least one lyophilized neutral substance.

3. The container according to claim 1, wherein the container is selected from a group consisting of a syringe, a carpule, a dual- or multi-chamber system, a vial, an infusion bag and an infusion bottle.

4. The container according to claim 1, further comprising a solvent and a plug disposed between the solvent and the at least two layers of lyophilized active substances and/or auxiliary substances.

5. The container according to claim 4, wherein the container defines a bypass such that displacement of the plug with the container allows the solvent to be conveyed around the plug to dissolve the at least two layers of lyophilized active substances and/or auxiliary substances.

6. The container according to claim 5, wherein the bypass is a region of increased diameter.

7. The container for medical products of claim 1, where the at least two layers of lyophilized active substances and/or auxiliary substances are present in a first chamber, the container comprising a second chamber separated from the first chamber by a displaceable plug, the second chamber containing a solvent.

8. The container for medical products of claim 7, wherein displacing the plug allows the solvent to mix and dissolve the at least two layers to generate the chemiluminescence or bioluminescence phenomenon.

9. The container for medical products of claim 1, wherein the luminous components are suitable for being administered a patient through at least one of an injection, an ingestion, an enema, and an application to skin.

10. A method for producing a container for medical products, the method comprising:

a) providing the container, the container having at least one chamber;

b) filling a first solution of a luminous component and an active substance and/or auxiliary substance into the at least one chamber;

c) quick-freezing the first solution;

d) filling a second solution of a luminous component and an active substance and/or auxiliary substance into the at least one chamber;

e) quick-freezing the second solution;

f) filling a neutral substance into the at least one chamber such that the neutral substance separates the first solution from the second solution;

g) quick-freezing the neutral substance; and h) lyophilizing the frozen first and second solutions and the frozen neutral substance in the container, wherein the first and second solutions react with each other when the layers of active substances and/or auxiliary substances are dissolved and mixed by a solvent to generate a chemiluminescence or bioluminescence, and wherein the luminous components react with each other at a faster rate than the rate at which the active substances and/or auxiliary substances react with each other.

11. The method according to claim 10, wherein the neutral substance forms a neutral solution.

12. The method according to claim 10, further comprising dissolving the neutral substance with the solvent.

13. A container for medical products comprising:

a first chamber;

a second chamber;

layers of active substances in lyophilized form on top of each other in the first chamber;

layers of neutral substances arranged between adjacent ones of the layers of active substances such that contact between the adjacent layers of active substances is avoided;

luminous components integrated in the layers of active substances;

a solvent in the second chamber for dissolving the layers of active substances and the neutral substances; and a plug separating the first and second chambers, the plug being displaceable within the container to allow the solvent to come in contact with the layers of active substances and the neutral substances, wherein the contact of the solvent with the layers of active substances results in either a chemiluminescence or bioluminescence phenomenon if the active substances have not reacted with each other prior to being dissolved and mixed by the solvent, and wherein the luminous components react with each other at a faster rate than the rate at which the active substances react with each other.

14. The container of claim 13, wherein the container defines a bypass such that displacement of the plug with the container allows the solvent to be conveyed around the plug to dissolve the layers of active substances and the neutral substances.

15. The container of claim 14, wherein the bypass is a region of increased diameter.

16. A container for medical products comprising:

a first chamber;

a second chamber;

a bypass positioned between the first chamber and the second chamber;

at least two layers of lyophilized active substances present in the first chamber and separated from each other by at least one lyophilized neutral substance such that contact between the layers of lyophilized active substances is avoided, wherein a luminous component is integrated into each layer of lyophilized active substance so that a chemiluminescence or bioluminescence phenomenon is generated when the at least two layers of lyophilized active substances are combined;

a solvent in the second chamber for dissolving the at least two layers of active substances and the at least one lyophilized neutral substance; and a plug separating the first and second chambers, the plug being displaceable within the container at the bypass to allow the solvent to come in contact with the at least two layers of active substances and the at least one lyophilized neutral substance, wherein the contact of the solvent with the at least two layers of active substances results in the chemiluminescence or bioluminescence phenomenon, which indicates that the at least two layers of active substances have not reacted with each other prior to being dissolved and mixed by the solvent, and wherein the luminous components react with each other at a faster rate than the rate at which the active substances react with each other.

* * * * *